United States Patent [19]

Squires

[11] Patent Number: 4,754,715

[45] Date of Patent: Jul. 5, 1988

[54] TOGGLE-TYPE SAFE DOOR LOCKING MECHANISM

[76] Inventor: William D. Squires, 312 W. Emma, Slater, Mo. 65349

[21] Appl. No.: 877,153

[22] Filed: Jun. 23, 1986

Related U.S. Application Data

[63] Continuation-in-part of Ser. No. 680,083, Dec. 10, 1984, abandoned.

[51] Int. Cl.[4] ..... E05G 1/04; E05B 63/02

[52] U.S. Cl. ..... 109/59 T; 109/74; 109/79; 70/155; 292/41; 292/DIG. 49

[58] Field of Search ..... 109/59 R, 59 T, 60, 109/61, 64, 65, 74, 76, 77, 79, 85; 292/35, 36, 41; DIG. 49, 166, 173, 161, 158, 207, 168; 70/283, 154, 155, 416–418; 49/395; 52/475, 483, 785

[56] References Cited

U.S. PATENT DOCUMENTS

| | | | |
|---|---|---|---|
| 1,421,771 | 7/1922 | Freyberg et al. | 109/77 |
| 1,442,731 | 8/1911 | Ohnstrand | 109/64 |
| 1,548,372 | 8/1925 | Moore | 292/173 |
| 1,576,609 | 3/1926 | Hunter | 109/75 |
| 1,948,602 | 2/1934 | Tracy | 109/77 |
| 2,996,322 | 8/1961 | McClellan | 292/36 |
| 3,392,490 | 7/1968 | Rami | 292/35 |
| 3,677,043 | 7/1972 | Cox | 70/283 |
| 3,889,421 | 6/1975 | Ahonon | 49/395 |
| 4,046,410 | 9/1977 | Connell | 292/36 |
| 4,446,798 | 5/1984 | Withington | 109/61 |
| 4,468,943 | 9/1984 | Beattie et al. | 70/302 |
| 4,520,736 | 6/1985 | Crosby et al. | 109/60 |

FOREIGN PATENT DOCUMENTS

| | | | |
|---|---|---|---|
| 234340 | 5/1925 | United Kingdom | 109/85 |

*Primary Examiner*—Neill Wilson

*Attorney, Agent, or Firm*—Schmidt, Johnson, Hovey & Williams

[57] ABSTRACT

An improved safe is provided which offers the security of currently known more complex safes at substantially less cost. The safe preferably includes a cabinet having apertured door frame structure, with a door having inner, outer and sidewalls. Locking apparatus located within the door includes a series of selectively operable toggle mechanisms, each having a pair of pivotal links coupled to a locking bolt. The locking bolts are designed to extend through the aligned frame and door apertures to lock the door. The frame structure is formed of interconnected, seamless webs integral with the cabinet walls and presenting a recess to receive the door lip. Additional security is achieved by reinforcing the door lip with flange structure forming a part of the marginal door frame and by attaching the handle to the actuator for the toggle mechanisms so that excess force renders the handle inoperative. Further, forced entry is inhibited by constructing the toggles so that in the locking position, the toggles are over center in a downward direction which causes any force exerted against the bolts to be directed downward against the bottom wall of the door.

9 Claims, 2 Drawing Sheets

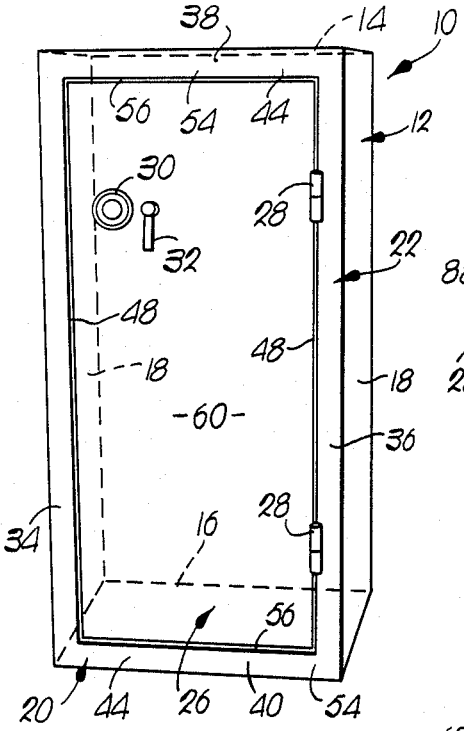
Fig. 1.
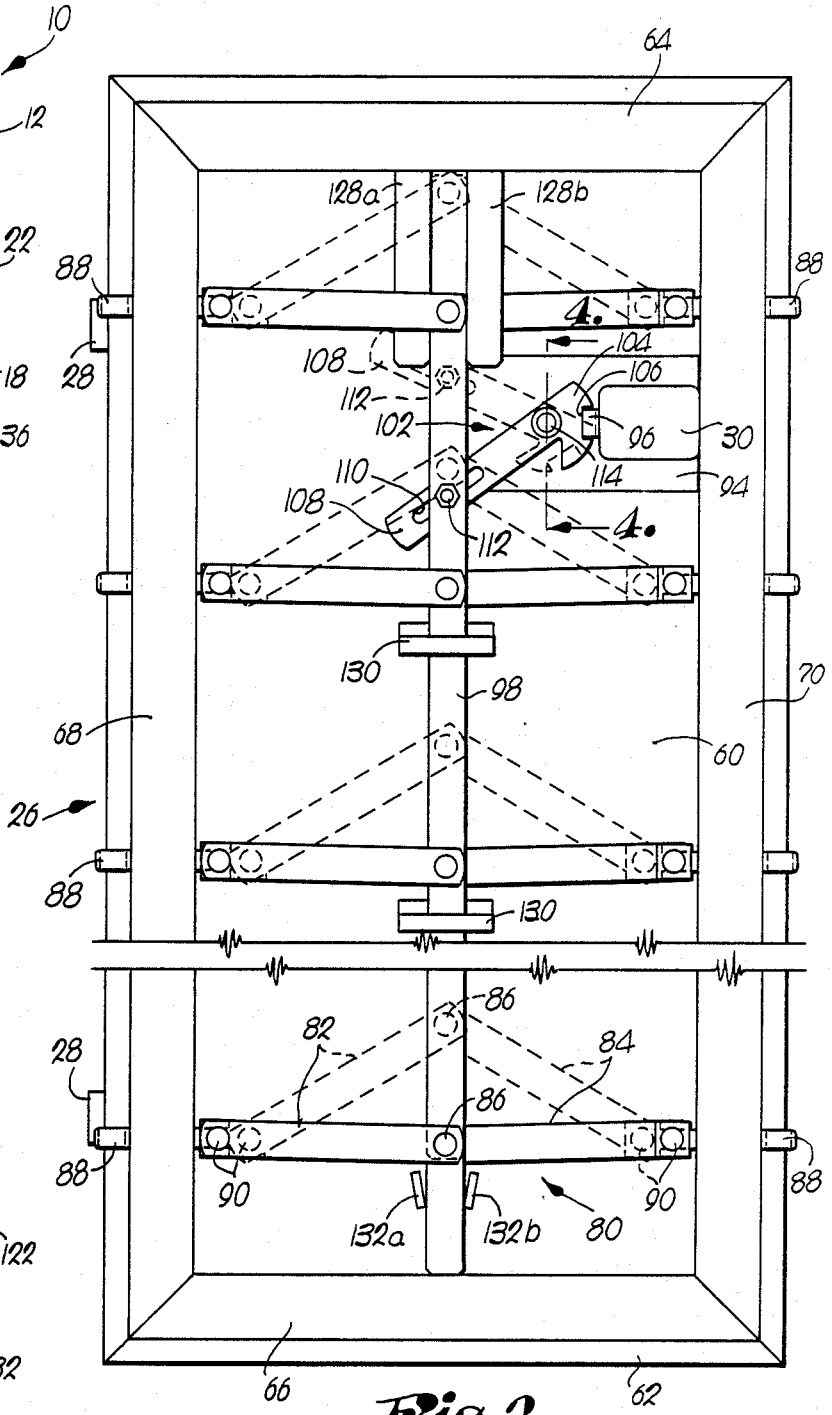
Fig. 2.
Fig. 4.
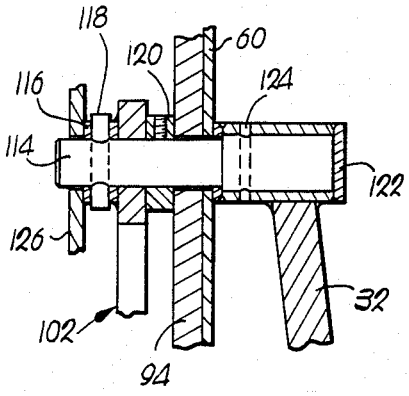
Fig. 3.
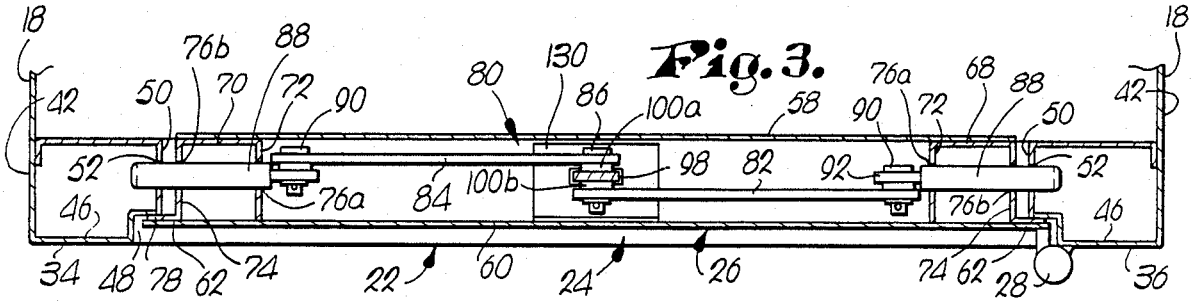

TOGGLE-TYPE SAFE DOOR LOCKING MECHANISM

This is a continuation-in-part of abandoned application Ser. No. 06/680,083 filed Dec. 10, 1984 and entitled "Gun Safe."

BACKGROUND OF THE INVENTION

1. Field of the Invention

The present invention is broadly concerned with an improved safe of simple yet highly effective construction which essentially provides equivalent security to that offered by more complex safes at substantially less expense. More particularly, it is concerned with a safe having apertured frame structure, a door with corresponding apertured sidewall sections, and apparatus for locking the door in a closed position including one or more toggle mechanisms for operatively extending and retracting locking bolts.

2. Description of the Prior Art

Many people would like to own a safe in their home or at their place of business in order to securely store valuables, such as jewelry, guns, or important documents. However, the cost of purchasing a safe for these purposes is often prohibitive, primarily because conventional safes are very expensive to build. In part, the substantial cost is attributable to the conventional use of complex locking mechanisms, typically including slide bolts, combination type locks, and a slide bolt actuating assembly involving a rotatable idler connected by various links and cranks so that the slide bolts are retracted and extended in and out of their locked position by rotation of the idler. Such systems are complex to design and build and contain too many working parts capable of malfunctioning or otherwise improperly operating.

A number of safes have been proposed in the past for decreasing the complexity and expense of conventional safes, while attempting to retain the desired security attributes. In general, however, these safes have not solved the problem because they merely substitute complexities of their own. Patents illustrating such prior units include U.S. Pat. Nos. 4,446,798 and 4,468,943.

SUMMARY OF THE INVENTION

The problems outlined above are in large measure solved by the safe in accordance with the present invention which is rugged, sturdy, compact, dependable, and simple to construct, while still being substantially less expensive to build than previous safes.

The safe in accordance with the present invention broadly includes a cabinet whose front includes door frame structure, opposed wall sections of which include locking-bolt receiving apertures. A door is hinged to the frame structure and has sidewall portions with apertures oriented for alignment with the frame apertures when the door is closed. Means is also provided for locking the door, including one or more toggle mechanisms attached to locking bolts for insertion into the frame structure apertures, along with apparatus for selectively operating the toggle mechanisms in order to retract and extend the bolts in and out of the frame aperture.

In particularly preferred forms, the frame structure includes tubular frame rails which include seamless webs integral with the corresponding cabinet wall. Each web is configured so that is presents a front panel which continues into a recess along the inner edge of the panel. The innermost edge of the web is then welded to a rearwardly extending inboard wall portion.

Additionally, even greater security can be provided by connecting the inner and outer door walls by marginal rail structure, the latter in effect forming the aforementioned door sidewall portions.

The door rail structure includes an outboard web terminating in a laterally extending flange which is joined to a lip circumscribing the outer wall of the safe door. This flange provides and additional layer of material for reinforcement of the outer wall of the safe door and provides additional resistance to a would be safecracker.

Furthermore, a preferred version of the locking apparatus includes an operating bar pivotally interconnected with the toggle mechanisms which is raised and lowered through an upright actuator operated by an exterior handle. The handle is attached to the actuator by means including a shear pin and pivot shaft so that any excess rotational force on the handle will render the latter incapable of operating the actuator. The dimensions and configuration of the locking apparatus are such that when the door is in its locked position, the toggle mechanisms will be located over center in a downward position. This provides substantial resistance to an attempted force opening of the safe. That is to say, if an opening force is exerted on the bolts, the over center orientation of the toggles transfers the forces directly to the door frame rather than in a direction for retracting the bolts.

A second embodiment of the present invention includes a mechanism for operating and locking a safe door which broadly includes at least one reciprocal locking bolt selectively shiftable between locking and unlocking positions and means for selectively shifting the bolt between the positions. More particularly, the shifting means includes a toggle operatively connected with the locking bolt, and an elongated operating bar operatively connected to the toggle for operating the toggle when the bar is axially shifted. The toggle is designed to be in an over-center position when the bolt is in its locking position. Advantageously, the locking mechanism includes means for locking the bar in its locking position including a rigid element engaged by the operating bar to prevent further axial movement of the bar when it is in a locked position, and selective latching means engageable with the bar for preventing axial movement of the bar in the other axial direction. The latching means has a bar-engaging latching member and a handle means coupled with the member and located exteriorly of the outer panel of the safe door for selective movement of the latching member.

The preferred locking mechanism includes an actuator bar having a pivot shaft coupled with the actuator between its respective ends with the shaft being adapted for coupling with the front panel of a lockable door. The actuator bar is rotatable about the shaft. The actuator bar also includes a notch in its first end adapted for receiving a locking tongue reciprocal between locked and unlocked positions which tongue prevents rotation of the actuator means when it is received in the notch. A longitudinally extending slot is defined in the actuator bar and is adapted for slidably and operatively receiving a locking connector which is included as part of the door mechanism. The actuator bar additionally includes a second slot defined therein which is in communication with and at an acute angle to the first slot and is also adapted for slidably and operatively receiving the connector. The actuator bar is configured so that when the notch receives the tongue and when a force is applied to shift the connector, the connector is received in the second slot, abuts the end thereof remote from the first slot, and transmits substantially all of the applied force to the shaft thereby preventing substantial transmission of the force to the tongue. In particularly preferred forms, the shaft is fixedly coupled with the actuator and rotatably coupled with the safe wall for extending through the wall to fixedly receive an operating handle.

Additionally, the second embodiment includes a toggle device which is comprised of first and second arms pivotally intercoupled at their respective ends, and a locking bolt pivotally connected with an end of the second arm remote from the intercoupling of the two arms. More particularly, the first arm includes a longitudinal slot adapted for slidably and operatively receiving an operating pin which is affixed to the front panel of a safe door or the like. The end of the first arm remote from the intercoupling is pivotally connected to the locking mechanism which is included as part of the safe door and the locking bolt is adapted for reciprocal movement through the wall aperture defined in the safe door. The toggle device is configured so that movement of the locking mechanism between locked and unlocked positions causes the end of the first arm coupled thereto to move in a direction substantially normal to the longitudinal axis of the second arm which in turn causes the slot to slide along the pin which in turn causes axial movement of the second arm to correspondingly move the locking bolt through the wall aperture.

Finally, the second embodiment includes a safe door comprising a body having an inner wall and a facially opposed, spaced-apart outer wall presenting a continuous circumscribing lip; means interconnecting the inner and outer walls including a connecting structure having an integral, marginal, transverse web interconnecting the inner and outer walls and having an integral, outwardly extending flange in parallel, coincident, abutting engagement with the lip; and a reinforcing member having an integral, marginal, elongated, first leg transversely located between the inner and outer walls having an integral, marginal, outwardly-extending second leg in parallel, abutting engagement with the flange. The lip, flange, and second leg together form a laminated, continuous, circumscribing, anti-tampering structure designed to resist any prying of the door to open it.

BRIEF DESCRIPTION OF THE DRAWINGS

FIG. 1 is a perspective view of a gun safe in accordance with the present invention;

FIG. 2 is a fragmentary rear view of the gun safe door of FIG. 1, illustrating the locking toggle and bolt mechanisms in an extended, locked position, end with the retracted position of the toggle and bolt mechanisms being depicted in phantom;

FIG. 3 is a fragmentary sectional view of the door and frame structure of the gun safe, with the locking bolts being in their extended locked position and received within the corresponding frame apertures;

FIG. 4 is a fragmentary side view of the handle and actuator assembly of the gun safe.

DESCRIPTION OF THE PREFERRED EMBODIMENT

Figure 6:
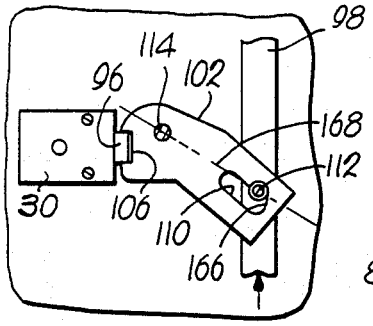
FIG. 6 is a fragmentary view illustrating the preferred linkage assembly of the FIG. 5 door coupling the toggle operator bar and the safe lock, showing the locked orientation of the overall assembly.

Referring now to the drawing, FIG. 1 illustrates a gun safe 10. Safe 10 includes a box-like cabinet 12 which includes top and bottom walls 14 and 16, sidewalls 18, and a front 20 in the form of frame structure 22. The latter defines a doorway 24, and a door 26 is attached to the frame structure 22 by hinges 28. A combination lock 30 and a handle 32 are located on the exterior face of door 26. The cabinet, safe door, and external fixtures of the safe are constructed from rugged metallic materials well known to those skilled in the art.

In more detail, and referring to FIG. 3, frame structure 22 has a pair of upright tubular frame rails 34 and 36 respectively located on either side of doorway 24 along with top and bottom rails 38 and 40. Rails 34, 36 each include a continuous seamless web member 42 which is integral with and forms a continuation of the corresponding adjacent cabinet sidewall 18. In like manner each of the top and bottom rails 38 and 40 include a web member 44 which is integral with and forms a continuation of top and bottom walls 14 and 16. Each side web member 42 includes an elongated laterally extending front panel 46 and an elongated upright recess 48 along the innermost edge of front panel 46. Side web member 42 is welded along its innermost edge to a rearwardly extending inboard wall portion 50. Inboard wall portion 50 contains a series of vertically spaced apertures 52 to allow receipt of locking bolts. Similarly, top and bottom webs 44 have a vertical outer face 54 and a recess 56, and are welded to a rearwardly extending inboard wall (not shown). The frame rails 34, 36, 38 and 40 are interconnected at their edges and thus present a door frame which is in effect a continuous piece of material integral with the cabinet to enhance the strength and appearance characteristics of the overall safe.

Door 26 is depicted in detail in FIGS. 2 and 3. Door 26 is secured to frame structure 22 by hinges 28 and is thereby shiftable between open and closed positions. Door 26 includes an inner wall 58 and an opposed outer wall 60, with the outer edge of wall 60 presenting a lip 62 which is configured to be received within the frame rail recesses 48 and 56 when the door 26 is in its closed position. Inner wall 58 is connected to outer wall 60 by door rails 64, 66, 68 and 70 located at the top, bottom and side margins of door 26. Side marginal door rails 68 and 70 each have an upright inboard web 72 and a similar, laterally spaced apart outboard web 74. Door rails 68 and 70 include vertically spaced aperture pairs **76*a*, 76*b* through the associated inboard web 72 and outboard web 74 which are oriented for alignment with corresponding frame rail apertures 52 when door 26 is closed. Each outboard web 74 has a laterally extending flange 78 which is welded to lip 62. Flange 78 thus provides a double thickness of metallic material at a point where attempted forcible entry by prying means may be anticipated. Further, the location of the reinforced flange 78 and lip 62 within the frame recesses 48 and 56** affords minimum purchase to the pry tools of a hopeful safecracker.

The locking door mechanism includes a plurality of vertically spaced, superposed toggle mechanisms 80. Four identical toggles 80 are shown in FIG. 2 for illustrative purposes, but a greater or lesser number may be equally appropriate depending on the size and configuration of the safe. Each toggle 80 consists of a pair of links 82 and 84 pivotally interconnected at its outer end to a locking bolt 88 by appropriate pivotal connector 90 extending through apertured bolt tang 92. Toggles 80 and locking bolts 88 are located within door 26 between the door walls 58 and 60. The pivotal axis of each toggle 80 at link connector 86, and the pivotal axis of each toggle 80 and bolt 88 at bolt connector 90, are substantially transverse to the door walls 60, 62. Each bolt 88 is oriented for back-and-forth lateral reciprocation through a corresponding aperture pair 76*a*, 76*b* in side door rail 68 and 70. Each bolt 88 is of a sufficient length to extend through the associated door rail 68 or 70 and into a corresponding frame aperture 52.

The interior portion of combination lock 30 is fastened to a backing plate 94 and to the interior face of door wall 60. Lock 30 has a locking tongue 96 which extends outwardly from combination lock 30 when the latter is locked, and is retracted inwardly into combination lock 30 when the lock is unlocked.

Each toggle 80 is pivotally interconnected with an upright, up and down reciprocal opeating bar 98 by the corresponding link connectors 86. As best seen in FIG. 3, the bar 98 is sandwiched between the links 82, 84 of each toggle 80, and operating bar spacers 100*a*, 100*b* are provided between the links and bar to assure smooth operation.

Bar 98 is raised and lowered by means of an actuator 102. Actuator 102 includes an arcuate upper portion 104 notched as at 106 (shown in phantom in FIG. 2), and an elongated shank 108 having a slot 110. Actuator 102 is attached to bar 98 by a connector 112 which extends through and is movable along slot 110. Slot 110 is of sufficient length to permit full raising and lowering of bar 98. Notch 106 is configured to receive locking tongue 96 when the actuator 102 is in the full line position of FIG. 2 and lock 30 is locked.

A pivot shaft 114 extends through door wall 60 and backing plate 94 and is fixedly coupled to actuator 102 by collar 116 and pin 118. Pivot shaft spacer 120 is provided between actuator 102 and backing plate 94 to assure smooth operation. Pivot shaft 114 is also fixedly coupled to handle 32 by housing 122 and shear pin 124 so that handle 32 and actuator 102 rotate in unison. The pivot shaft and actuator assembly is covered by an interior cover plate 126.

The dimensions and orientation of bar 98 and links 82 and 84 are such that when bar 98 is in its fully lowered position, it will bottom out against door bottom rail 66, and toggles 80 will be slightly over center in a downward position.

In order to maintain correct upright position of bar 98 during the full range of its motion, top slide retainers 128*a* and 128*b*, intermediate slide retainers 130, and bottom guides 132*a* and 132*b* are provided.

In use, to unlock the safe, the correct combination is dialed on combination lock 30 to cause locking tongue 96 to retract as shown in phantom in FIG. 2. Actuator 102 is then rotated by turning handle 32 in a counterclockwise direction. As acutator 102 is rotated, bar 98 moves upwardly, causing toggles 80 to collapse. This in turn causes links 82 and 84 to move toward each other whereby locking bolts 88 are retracted from the apertures 52 of the frame structure 22. Door 26 can then be swung open. As soon as handle 32 is released, gravity causes bar 98 to descend and bottom out against bottom rail 66, and as a consequence the toggles 80 are extended along with the bolts 88. In this orientation, inadvertent locking of door 26 is impossible inasmuch as the extended bolts 88 prevent full closing of door 26.

To lock the safe, handle 32 is grasped and rotated to effect retraction of bolts 88, and door 26 is closed. Handle 32 is then released to allow bar 98 to fall to its fully lowered position. This causes links 82 and 84 to drop into their extended lower position and causes bolts 88 to extend fully through the apertures 76*a*, 76*b* and 52. The dial on combination lock 30 is turned to cause locking tongue 96 to extend into notch 106 in order to lock actuator 102 in its down position, thereby preventing rotation of actuator 102 and raising of bar 98 until lock 30 is unlocked and locking tongue 96 is withdrawn from notch 106.

As noted above, when bar 98 is in its fully lowered position, it will bottom out against door bottom rail 66, and toggles 80 will be slightly over center in a downward position. This provides additional resistance to unauthorized opening of door 26 because any lateral force exerted against a bolt 88 will be transmitted through the toggles 80 and be directed downwardly through bar 98 and against rail 66, thus effectively preventing any upward movement of the toggles 80. In a word, the more force is exerted against bolt 88, the more securely locked door 26 becomes. Also, when the door 26 is in its closed and locked position, lip 62 and reinforcement flange 78 lie within recesses 48 and 56 and present a double thickness of metallic material affording additional protection against prying. Furthermore, when door 26 is so locked, if any excessive rotational force is exerted on handle 32 in an opening direction, pin 124 will shear. Housing 122 and handle 32 will no longer be fixedly coupled to pivot shaft 114, but will merely spin on the shaft; thus handle 32 will no longer be capable of raising actuator 102, and the attempted forced opening will be thwarted.

It will thus be seen that the present invention provides a greatly simplified yet completely secure safe apparatus particularly designed to overcome the problems heretofore encountered in the construction of safes.

FIGS. 5–9 illustrate a second embodiment of safe 10. The second embodiment is similar to the first and corresponding similar components are numbered the same.

Figure 5:
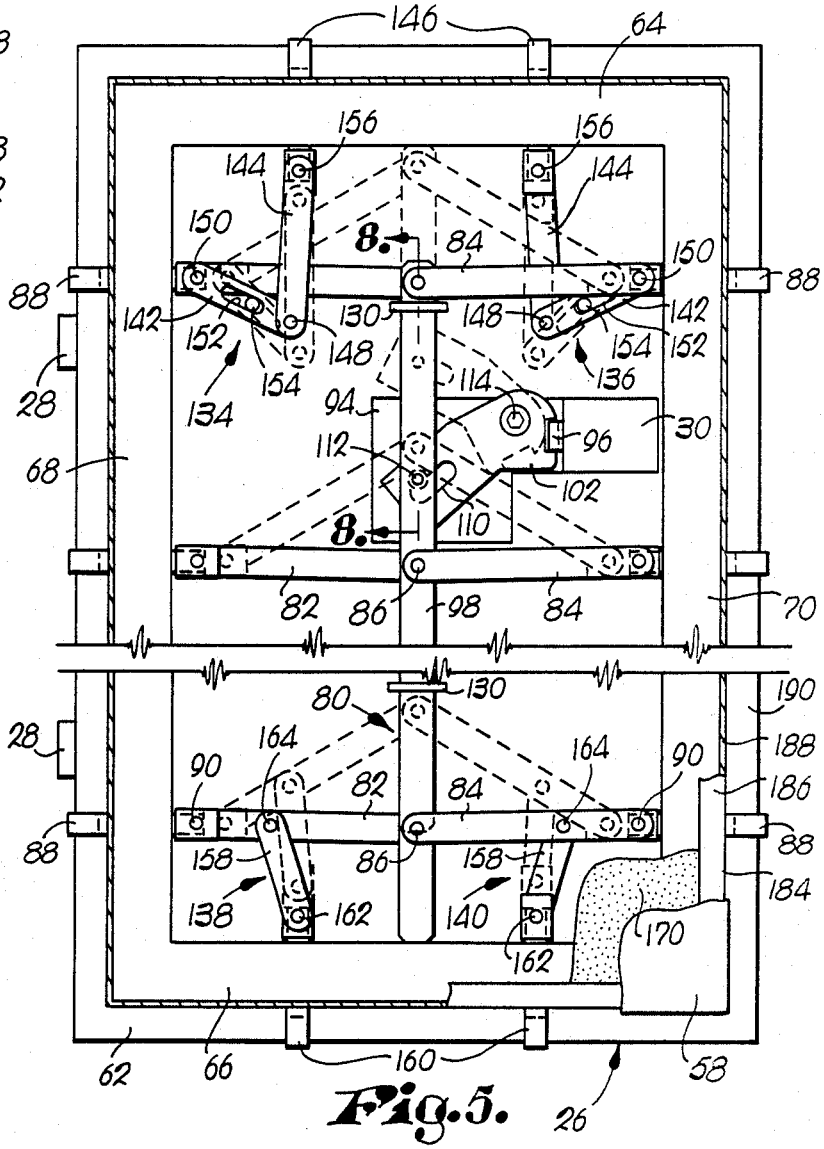
FIG. 5 is a fragmentary rear view of another safe door construction in accordance with the invention.

The second embodiment of gun safe 10 includes additional toggle devices 134, 136, 138, and 140 as illustrated in FIG. 5. Upper toggle devices 134, 136 each include toggle arms 142 and 144 and locking bolts 146. Arms 142 and 144 are pivotally connected at respective ends thereof by arm pivot pins 148. Pivot pins 150 pivotally interconnect arms 142 with toggle links 82, 84 respectively at the outboard ends thereof. Arms 142 also include operating slots 152 each slidably receiving therein operating pins 154 fixed to door 26.

Locking pins 156 pivotally interconnect locking bolts 146 with corresponding arms 144 near the ends of arms 144 remote from pins 148. In use, the locking bolts 146 are operably received through a pair of aligned locking apertures (not shown) through door rail 64 and top rail 38.

Bottom toggle devices 140 and 142 each include a toggle member 158 operably connected with bottom locking bolts 160 by pivot pins 162. Connector pins 164 coupled the other ends of members 158 to adjacent links 82 and 84. Aligned bottom locking apertures (not shown) receive bottom locking bolts 160 of toggle devices 138, 140 respectively through door rail 66 into bottom rail 40.

In use, toggle devices 134–140 serve to provide additional locking security for the top and bottom of door 26. Pins 146, 160, in combination with pins 88, provide all around locking security for door 26. In operation, when tongue 96 of combination lock 30 is retracted and handle 32 is turned, bar 98 moves upwardly to move toggle mechanisms 80 and toggle devices 134–140 into the positions shown in FIG. 5 by the phantom lines.

As links 82, 84 move into the open position, their respective ends remote from connecting pin 86 move toward the vertical center line of door 26. When this occurs, arms 142 of the toggle devices 134, 136 pivot about pins 150, slots 152 slide along pins 154, arms 144 move downwardly, and bolts 146 retract from top rail 38.

Bottom toggle devices 138, 140 are connected to links 82, 84 in a position such that upward movement of links 82, 84 causes upward movement of toggle members 158 which in turn retracts bolts 160 from bottom rail 40. Thus, upward movement of bar 98 causes retraction of bottom locking bolts 160, bolts 88, and top locking bolt 146.

Figure 7:
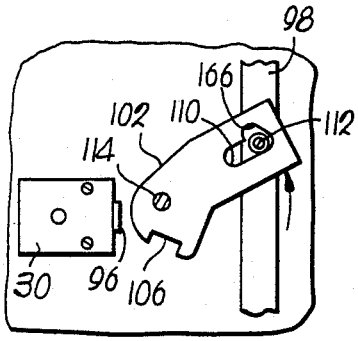
FIG. 7 is a view similar to that of FIG. 6, but depicting the overall assembly in an unlocked position.
Figure 8:
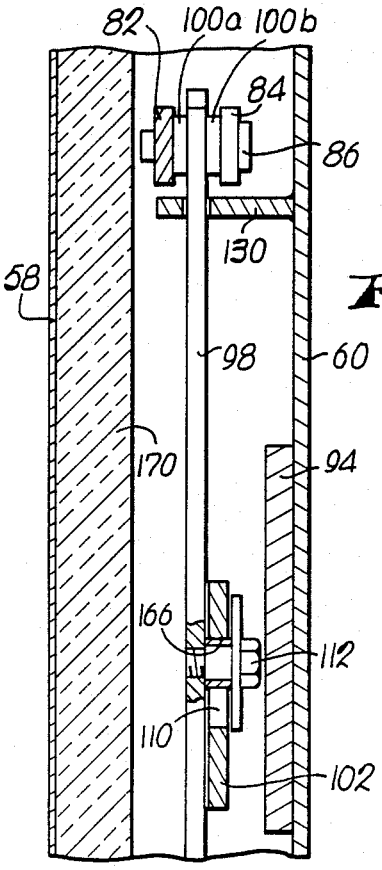
FIG. 8 is a partial, side sectional view of the FIG. 5 door illustrating details of the linkage assembly.

Referring now to FIGS. 6–8, actuator 102 includes a relatively small locking notch or slot 166 defined therein. Slot 166 is in communication with slot 110 and effectively forms an extension thereof but at an acute angle of about 45 degrees with respect to slot 110.

The purpose of slot 166 is to provide substantial additional security against unauthorized entry in the event someone cuts a hole in door 26 to gain access to bar 98. Without slot 166, forcible upwardly movement of bar 98 could serve to rotate actuator 102 about pin 114 which in turn would translate into downwardly directed shearing force against tongue 96. Sufficient force on bar 98 may distort or break tongue 96, allowing arm 98 to be raised to unlock door 26.

Slot 166 prevents this, however, by dramatically changing the stress points resulting from any forced upward movement of bar 98. As bar 98 is moved upwardly, as shown in FIG. 6, pin 112 slides up into slot 166 to abut the upper end thereof. Continued upwardly directed force on bar 98 is translated into shearing force on pin 114 along axis 168. In this way, the design of slot 166 allows only a slight rotational translation of force onto tongue 96 while providing that most of the upwardly directed force on bar 98 is translated into a shearing force on pin 114. Pin 114 is composed of high strength steel of a type well known to those skilled in the art and is highly resistant to any such shearing force. As such, forces developed during a forced opening are safely absorbed without allowing entry to the safe itself.

Figure 9:
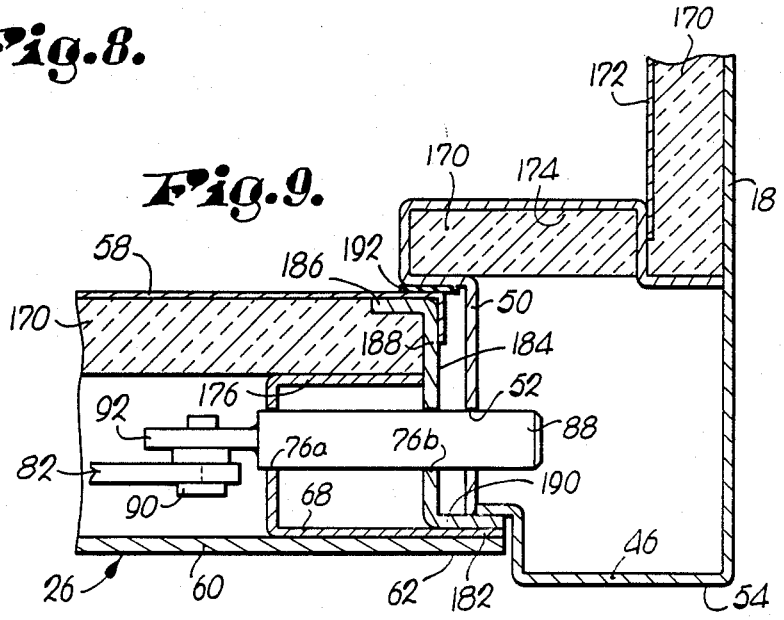
FIG. 9 is an enlarged, fragmentary sectional view depicting the safe door of FIG. 5 and its associated frame, with a toggle bolt in an extended locked position.

The second embodiment of safe 10 also provides for the addition of conventional heat resistant insulation material 170 about the interior of safe 10 (FIG. 9). Insulation 170 is situated between sidewalls 18 and insulation covering 172. The interior top, bottom and back walls of cabinet 12 are similarly insulated and include insulation covering 172.

Insulation 170 is provided for frame rails 34, 36, top rail 38, and bottom rail 40 by modifying the shape of the walls of rails 34–40 to form a cavity 174. Insulation 170 fills cavity 174 in a manner which provides for insulation continuity with the insulation of the sidewalls as shown in FIG. 9.

Door 26 is modified to receive insulation 170 by widening the distance between door inner wall 58 and door outer wall 60 to thereby provide sufficient space to include insulation 170 adjacent inner wall 58 as shown.

The second embodiment of safe 10 additionally provides additional anti-pry protection as shown in FIG. 9. Door rails 64–70 are modified in the second embodiment to present inner web 176 inboard web 178, and outer web 180 which extends outwardly adjacent lip 62 to form flange 182. Reinforcing member 184 is Z-shaped as shown and includes inner leg 186 coupled with door inner wall 58, transverse leg 188, and outer leg 190 which continuously abuts flange 182.

Outer leg 190, flange 182, and lip 62 form a triple-layer of protection to resist prying open of door 26. This specific configuration allows reinforcing member 184 to be of substantial thickness in order to prevent prying but does not add substantial weight to safe 10. With the substantial strengh of member 184, rails 34–40 can be of thinner gauge metal than either lip 62 or outer leg 190 but at the same time the three layers of high strength steel substantially resist any prying force.

Rubber abutment seal 192 is affixed to the outboard surface of rails 34–40, this surface being formed to create cavity 174. Inner wall 58 abuts seal 192 when door 26 is closed thereby providing an airtight seal to prevent any damage to safe 10 contents by exterior heat or humidity.

I claim:

1. A safe, comprising: a box-like cabinet including a back wall, forwardly extending top, bottom and sidewalls, and a front, including doorway defining frame structure, said frame structure having a pair of upright, laterally spaced, side marginal, elongated tubular frame rails, each of said frame rails comprising:

a continuous seamless web member being a continuation of the corresponding cabinet sidewall and configured to present an elongated front panel and an elongated, upright recess along the inboard edge of said front panel, and a rearwardly extending inboard wall portion having a series of vertically spaced, locking bolt-receiving apertures therethrough;

a door, hingedly secured to said frame structure and shiftable between an open position and a closed position, said door comprising a body having an inner wall and a facially opposed, spaced apart outer wall presenting a continuous, circumscribing lip configured to be received within said frame rail recess;

means for interconnecting said door inner and outer walls, including a top door rail, a bottom door rail, and a pair of upright, laterally spaced, side-marginal, elongated, apertured door side rails, each of said door rails extending between said walls, with said door side rail apertures being vertically spaced and aligned with said frame rail apertures when said door is in said closed position, and each of said door side rails having upright, elongated, laterally spaced apart inboard and outboard webs, each of said door rail outboard webs having an outermost, laterally extending reinforcement flange adjacent the edge thereof proximal to said door outer wall and joined to said lip for reinforcing said lip against tampering;

means for locking said door in said closed position, including a plurality of vertically spaced toggle mechanisms situated between said door inner and outer walls, each of said toggles having a pair of pivotally interconnected links with the pivotal axis of each mechanism being substantially transverse to said door inner and outer walls;

a locking bolt operatively coupled with each link adjacent the end thereof remote from said pivotal interconnection, said locking bolts being oriented for back-and-forth lateral reciprocation through said aligned door side rail apertures and being of a length to extend through the latter and into said frame apertures for locking of said door;

a lock mechanism situated between said door inner wall and said door outer wall, having a locking tongue oriented for outward extension from the lock mechanism when said lock is in locked position and for inward retraction when the lock is in unlocked position; and means for simultaneously operating said toggle mechanisms in order to selectively retract said locking bolts from said frame rail apertures to thereby permit opening of said door, said operating means including an upright, elongated operating bar pivotally interconnected with each of said toggle mechanisms adjacent the point of pivotal interconnection of said links;

a handle on the exterior face of said door outer wall;

an actuator slotted at one end thereof for raising and lowering said operating bar, said actuator having a notch at the end thereof remote from said slot for engaging said locking tongue when said lock mechanism is in said locked position, said actuator being attached to said operating bar by fastener means extending through and slidable along the length of said slot;

a shaft extending through said door outer wall and fixedly coupling said handle and said actuator whereby rotation of said handle produces corresponding rotation of said actuator and vertical movement of said operating bar, said locking means being configured such that when said locking tongue is received by said actuator notch, said operating bar will be in its fully lowered position with the bottommost end thereof engaging said bottom door rail, said locking bolts will extend through said aligned door side rail apertures and into said frame rail inboard wall portion apertures, and said toggle mechanisms will be over center in a downward direction.

2. In a safe door operating and locking mechanism for use in a safe door presenting an outer panel and an apertured sidewall, said mechanism comprising:

at least one reciprocal locking bolt selectively shiftable between an extended locking position wherein the bolt extends through a sidewall aperture, and a retracted locking position;

means for selectively shifting said bolt between said positions thereof, including toggle means presenting a pair of pivotally interconnected links, one of said links supporting said bolt, an elongated, upright, axially shiftable operating bar operatively connected to said toggle means for operating the latter to shift said bolt from the locking position to the unlocking position thereof upon upward axial shifting of the bar, said toggle mechanism being over center in a downward direction when said bolt is in its locking position, and external, manually manipulable operating means operatively coupled with said bar for selective upward axial movement thereof to shift said bolt from said locking to said unlocking position, said bar being mounted for downward shifting movement thereof under the influence of gravity when said operating means is released, whereby the bolt moves from the unlocking to the locking position thereof in response to said gravity-induced bar movement; and means for selectively locking said bar against axial shifting thereof when the bar is in its downward position with said bolt in its extended locking position.

3. In a safe door presenting an inner wall, an opposed, spaced apart outer wall, and sidewalls extending between said inner and outer walls to define therewith a hinge side and a closure side for said door, tamper-resistant structure for preventing unauthorized opening of said door and comprising:

a lip formed as an integral portion of said outer wall and extending laterally beyond the adjacent sidewall of theclosure side of said door;

a flange formed as an integral portion of the margin of said closure side sidewall adjacent said outer wall, said flange extending laterally from the closure side sidewall in juxtaposition with said lip;

an internal reinforcing member located between said inner and outer walls and adjacent said closure side sidewall, said member including a transversely extending first leg between said inner and outer walls, and an integral second leg extending between and facially abutting said lip and flange, said lip, flange and second leg being interconnected to cooperatively present a triple laminated door sealing section extending laterally from said closure side sidewall for engaging a complemental door frame.

4. A safe door operating and locking mechanism for use in a safe door presenting an outer panel and a circumscribing, apertured sidewall, said mechanism comprising:

at least one reciprocal locking bolt selectively shiftable between an extended locking position wherein the bolt extends through a sidewall aperture, and a retracted unlocking position;

means for selectively shifting said bolt between said positions thereof, including toggle means presenting a pair of pivotally interconnected links, one of said links supporting said bolt, and an elongated operating bar operatively connected to said toggle means for operating the latter upon axial shifting of the bar, said toggle mechanism being in an over center position, and said bar being in a corresponding locking position, when said bolt is in the extended locking position thereof;

means for locking said bar in said corresponding locking position thereof, including a rigid element being a portion of said sidewall and located for engagement by said bar in the corresponding locking position of the bar for preventing further axial movement of the bar in one axial direction; and selectively operable latching means engageable with said bar for preventing axial movement of the bar in the other axial direction, said latching means having a bar-engaging latching member, and handle means coupled with said member and located exteriorly of said outer panel for selective movement of the latching member into and out of a latching position.

5. The mechanism as set forth in claim 4, including a plurality of said bolts each supported by a respective toggle means.

6. The mechanism as set forth in claim 4, said bar being oriented for up and down axial movement.

7. The mechanism as set forth in claim 4, said latching member including structure defining an elongated slot therein, said bar having a pin affixed thereto and extending into said slot for axial shifting of said bar upon pivotal movement of the latching member.

8. An actuator bar for use in a door locking mechanism, said mechanism including a reciprocal locking tongue movable between an extended, locking position and a retracted, unlocking position, and a shiftable operating element spaced from said tongue, said element supporting a connector pin and being operably coupled with extensible door locking means, said bar comprising:

an elongated body presenting a first element-connecting end and a second tongue-connecting end, structure defining a tongue-receiving notch adjacent said second end, said body being pivotal between a locking position wherein said notch is aligned for receiving said tongue, and an unlocking position wherein said notch is out of alignment with said tongue;

an elongated pivotal shaft operably supported by said body and extending transversely of the longitudinal axis of said body;

means defining an elongated, connector pin-receiving slot adjacent said first end for slidably receiving said pin;

means defining a pin-catching concavity in communication with and forming an extension of said slot, said concavity being oriented for receiving said pin when said body is in said locking position thereof, whereby upon shifting of said operating element and consequent attempted pivoting of the body to said unlocking position, potentially destructive forces developed as a result of said pivoting are absorbed by said shaft and said tongue is substantially isolated from said forces.

9. The mechanism as set forth in claim 8, wherein said shaft is fixedly coupled with said body and adapted for rotatably coupling with said door and for extending through said door to fixedly receive a handle means thereon.

* * * * *